US012716624B2

(12) United States Patent
Ikari et al.

(10) Patent No.: US 12,716,624 B2
(45) Date of Patent: Aug. 25, 2026

(54) AIR CONDITIONING SYSTEM

(71) Applicant: DAIKIN INDUSTRIES, LTD., Osaka (JP)

(72) Inventors: Kazuki Ikari, Osaka (JP); Junichi Shimoda, Osaka (JP); Hiroyuki Imada, Osaka (JP); Naoyuki Ohta, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 253 days.

(21) Appl. No.: 18/045,832

(22) Filed: Oct. 12, 2022

(65) Prior Publication Data

US 2023/0068005 A1 Mar. 2, 2023

Related U.S. Application Data

(63) Continuation of application No. PCT/JP2021/022132, filed on Jun. 10, 2021.

(30) Foreign Application Priority Data

Jun. 17, 2020 (JP) ..... 2020-104208

(51) Int. Cl.
*F25B 41/26* (2021.01)
*F25B 13/00* (2006.01)

(52) U.S. Cl.
CPC ..... *F25B 41/26* (2021.01); *F25B 13/00* (2013.01); *F25B 2313/007* (2013.01); *F25B 2313/0233* (2013.01); *F25B 2313/02743* (2013.01)

(58) Field of Classification Search
CPC ..... F25B 2313/0233; F25B 2313/007; F25B 41/26; F25B 13/00
See application file for complete search history.

(56) References Cited

U.S. PATENT DOCUMENTS

2008/0209926 A1* 9/2008 Matsuoka ..... F25B 13/00 62/129
2009/0031737 A1* 2/2009 Ueno ..... F25B 13/00 62/470

(Continued)

FOREIGN PATENT DOCUMENTS

CN 105849481 A 8/2016
JP H08-200905 A 8/1996

(Continued)

OTHER PUBLICATIONS

English translation of International Preliminary Report on Patentability issued in corresponding International Application No. PCT/JP2021/022132 mailed Dec. 29, 2022 (5 pages).

(Continued)

*Primary Examiner* — Paul Alvare
(74) *Attorney, Agent, or Firm* — Osha Bergman Watanabe & Burton LLP

(57) ABSTRACT

An air conditioning system includes: an outdoor unit; indoor units; one or more refrigerant flow path switching devices that switch flow paths of a refrigerant between the outdoor unit and the indoor units; and external pipes extending from the outdoor unit to the indoor units. The air conditioning system is configured such that a sum of a first value and a first correction value is equal to or less than a predetermined upper limit value determined based on an industrial standard, where the first value is based on a total length of the external pipes from the outdoor unit to the indoor units via the one or more refrigerant flow path switching device, and the first correction value is based on a sum of capabilities of the indoor units connected to the one or more refrigerant flow path switching devices.

4 Claims, 7 Drawing Sheets

(56) References Cited

U.S. PATENT DOCUMENTS

| | | | | |
|---|---|---|---|---|
| 2015/0143841 | A1* | 5/2015 | Kawano | F25B 41/24 62/498 |
| 2015/0377508 | A1* | 12/2015 | Imada | F24F 11/83 62/159 |
| 2016/0146488 | A1* | 5/2016 | Ochiai | F24F 11/30 62/125 |
| 2016/0356516 | A1 | 12/2016 | Eguchi et al. | |
| 2016/0377332 | A1 | 12/2016 | Eguchi et al. | |
| 2018/0017293 | A1* | 1/2018 | Naito | F25B 13/00 |
| 2020/0348064 | A1* | 11/2020 | Takenaka | F24F 11/49 |
| 2022/0146158 | A1* | 5/2022 | Ohura | F25B 49/005 |

FOREIGN PATENT DOCUMENTS

| | | | |
|---|---|---|---|
| JP | H09264627 | A | 10/1997 |
| JP | 2015-114049 | A | 6/2015 |
| JP | 2018-087677 | A | 6/2018 |

OTHER PUBLICATIONS

International Search Report issued in corresponding International Application No. PCT/JP2021/022132 mailed Aug. 10, 2021, with translation (6 pages).
Written Opinion issued in corresponding International Application No. PCT/JP2021/022132 mailed Aug. 10, 2021 (3 pages).
Extended European Search Report issued in corresponding European Patent Application No. 21825057.9, dated Oct. 16, 2023 (7 pages).

* cited by examiner

FIG. 6

| SUM OF CAPACITIES OF INDOOR UNITS (kW) | FIRST VALUE (m) |
|---|---|
| LESS THAN 21.0 | 0.4 |
| 21.0 OR MORE AND LESS THAN 32.5 | 0.7 |
| 32.5 OR MORE AND LESS THAN 47.5 | 1.6 |
| 47.5 OR MORE AND LESS THAN 67.4 | 2.2 |
| 67.4 OR MORE AND LESS THAN 85.0 | 4.3 |

AIR CONDITIONING SYSTEM

TECHNICAL FIELD

The present disclosure relates to an air conditioning system.

BACKGROUND

There has been known a refrigerant flow path switching device configured to switch, in an air conditioner including an outdoor unit and a plurality of indoor units, among refrigerant flow paths between the outdoor unit and the plurality of indoor units, for individual switching between cooling operation and heating operation at each of the indoor units (see PATENT LITERATURE 1 or the like).

PATENT LITERATURE

PATENT LITERATURE 1: Japanese Laid-Open Patent Publication No. 2015-114049

SUMMARY

An air conditioning system of the present disclosure includes: an outdoor unit, a plurality of indoor units, and at least one refrigerant flow path switching device that switches a flow path of a refrigerant between the outdoor unit and the plurality of indoor units, in which a pipe length that is a sum of lengths of external pipes from the outdoor unit to the indoor units via the at least one refrigerant flow path switching device is set such that a value obtained by adding at least a first value determined in accordance with a sum of capabilities of the indoor units connected to the at least one refrigerant flow path switching device to the pipe length is equal to or less than an upper limit value determined in advance.

BRIEF DESCRIPTION OF THE DRAWINGS

FIG. 6 is a table exemplifying a first value corresponding to a sum of capabilities of a plurality of indoor units.

DETAILED DESCRIPTION

An air conditioning system of the present disclosure will be described in detail hereinafter with reference to the accompanying drawings. Note that the present disclosure is not limited to the following exemplification, but is intended to include all changes within meanings and a scope of claims and equivalents.

Figure 1:
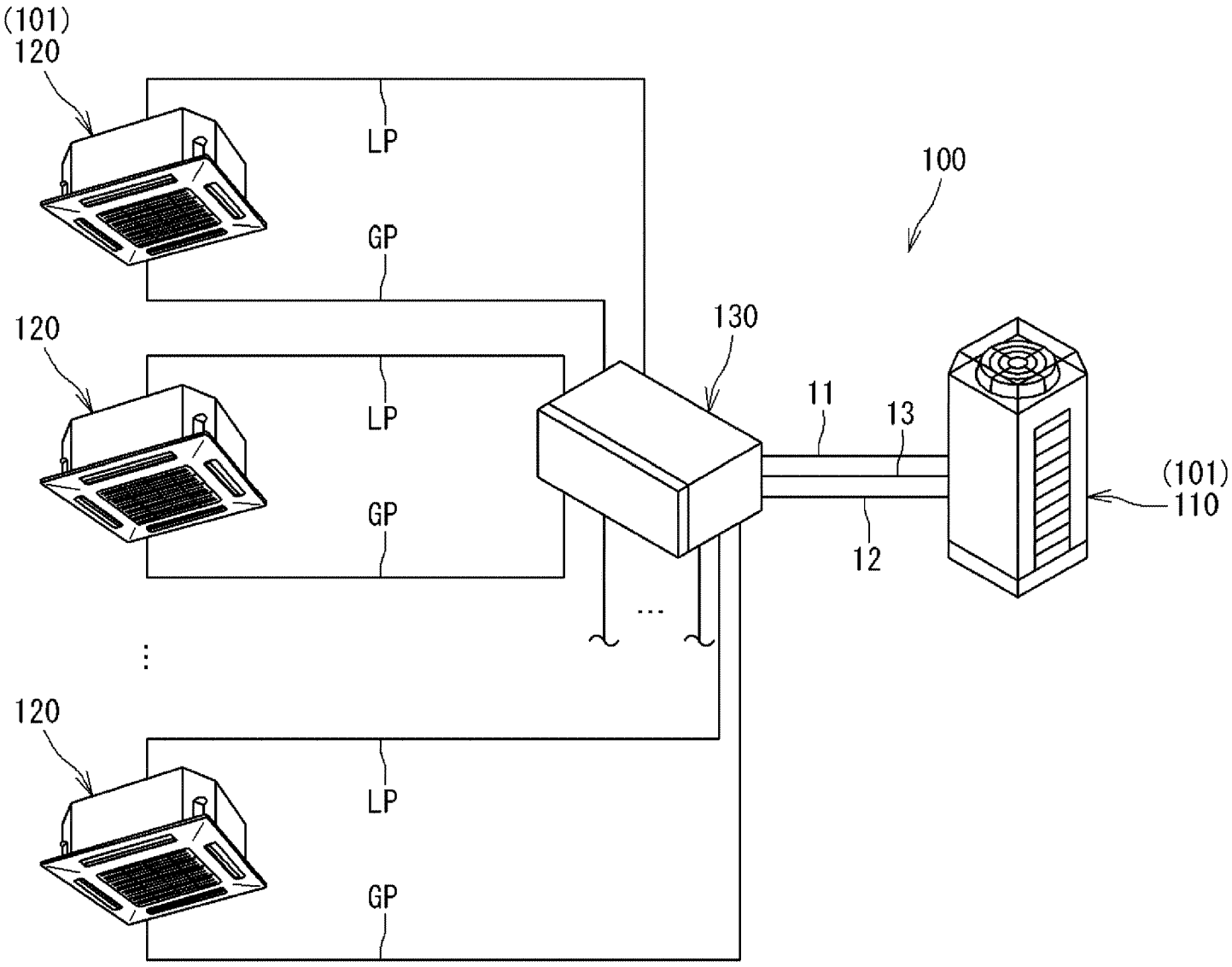
FIG. 1 is a configuration diagram of an air conditioning system according to one or more embodiments of the present disclosure.

FIG. 1 is a configuration diagram of an air conditioning system according to one or more embodiments of the present disclosure.

An air conditioning system 100 is installed in a building, a plant, or the like and achieves air conditioning in an air conditioning target space. The air conditioning system 100 includes an air conditioner 101 and a refrigerant flow path switching device 130. The air conditioner 101 is configured to execute vapor compression refrigeration cycle operation to cool or heat the air conditioning target space.

The air conditioner 101 includes an outdoor unit 110 as a heat source unit and an indoor unit 120 as a utilization unit. In the air conditioner 101, a plurality of the indoor units 120 is connected to the single outdoor unit 110 via the refrigerant flow path switching device 130. In the air conditioner 101, the refrigerant flow path switching device 130 is configured to freely select cooling operation or heating operation for each of the indoor units 120.

[Configuration of Outdoor Unit]

Figure 2:
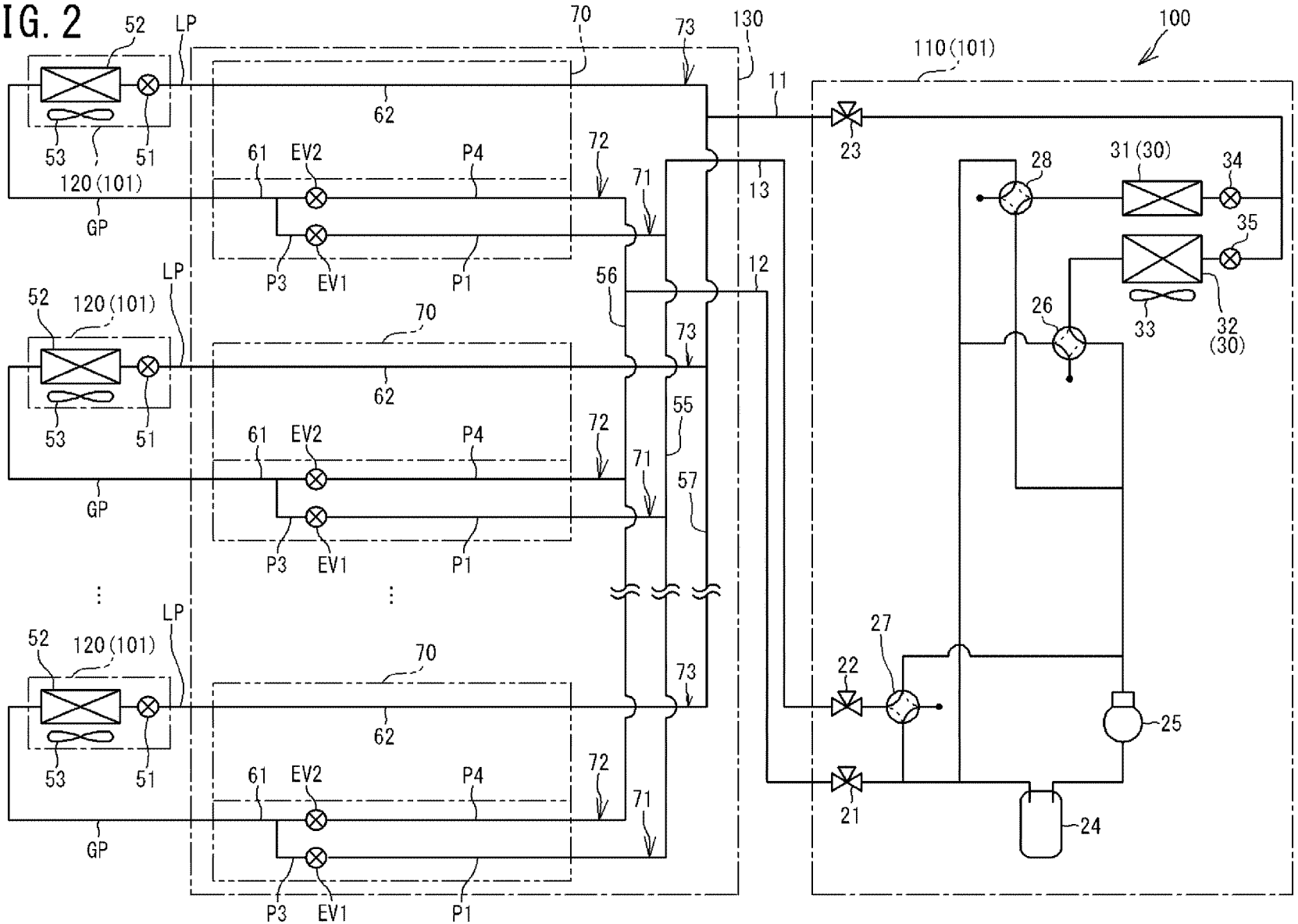
FIG. 2 is a refrigerant circuit diagram of the air conditioning system.

FIG. 2 is a refrigerant circuit diagram of the air conditioning system.

The outdoor unit 110 is installed outdoors such as on a roof or a balcony of a building, or underground.

The outdoor unit 110 includes a gas-side first shutoff valve 21, a gas-side second shutoff valve 22, a liquid-side shutoff valve 23, an accumulator 24, a compressor 25, a first flow path switching valve 26, a second flow path switching valve 27, a third flow path switching valve 28, an outdoor heat exchanger 30, an outdoor fan 33, a first outdoor expansion valve 34, and a second outdoor expansion valve 35. The outdoor heat exchanger 30 includes a first heat exchange unit 31 and a second heat exchange unit 32. The outdoor unit 110 is connected to the refrigerant flow path switching device 130 via a liquid connection pipe 11, a suction gas connection pipe 12, and a high and low-pressure gas connection pipe 13.

[Configuration of Indoor Unit]

The indoor unit 120 is of a ceiling embedded type, a ceiling pendant type, a floorstanding type, or a wall mounted type. The air conditioning system 100 according to one or more embodiments exemplarily includes four indoor units 120. The indoor unit 120 includes an indoor expansion valve 51, an indoor heat exchanger 52, an indoor fan 53, a liquid tube LP, and a gas tube GP.

[Configuration of Refrigerant Flow Path Switching Device]

The refrigerant flow path switching device 130 is provided between the outdoor unit 110 and the plurality of indoor units 120. The refrigerant flow path switching device 130 switches among refrigerant flow paths between the outdoor unit 110 and the plurality of indoor units 120.

Figure 3:
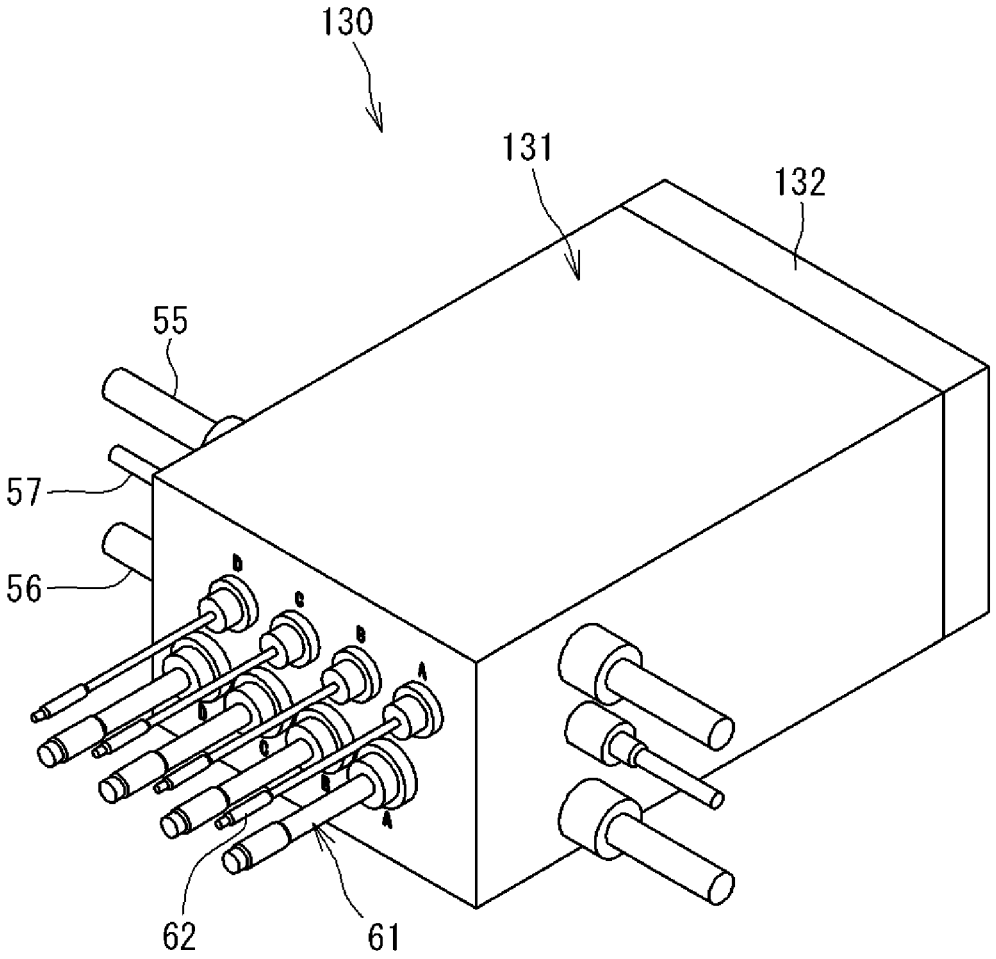
FIG. 3 is a perspective view of a refrigerant flow path switching device.

FIG. 3 is a perspective view of the refrigerant flow path switching device. As illustrated in FIG. 2 and FIG. 3, the refrigerant flow path switching device 130 includes a casing 131, a control box 132, a plurality of header pipes (refrigerant pipes) 55, 56, and 57, and a plurality of switching units 70. The plurality of header pipes 55, 56 and, 57 includes a first header pipe 55, a second header pipe 56, and a third header pipe 57.

The refrigerant flow path switching device 130 according to one or more embodiments includes four switching units 70. Each of the switching units 70 is connected with a single indoor unit 120. The refrigerant flow path switching device 130 according to one or more embodiments can thus be connected with four indoor units 120. The refrigerant flow path switching device 130 may alternatively include two, three, or five or more switching units 70, not limited to four switching units 70.

Each of the plurality of switching units 70 includes a first valve EV1, a second valve EV2, a first refrigerant tube P1, a third refrigerant tube P3, a fourth refrigerant tube P4, a utilization gas pipe 61, and a utilization liquid pipe 62. Each of the switching units 70 switches a flow of the refrigerant by adjusting opening degrees of the first valve EV1 and the second valve EV2.

The switching unit 70 includes a plurality of first branch pipes 71 branching from the first header pipe 55, a plurality of second branch pipes 72 branching from the second header pipe 56, and a plurality of third branch pipes 73 branching from the third header pipe 57. The first branch pipe 71 includes the first refrigerant tube P1, the third refrigerant tube P3, and the utilization gas pipe 61. The second branch pipe 72 includes the fourth refrigerant tube P4 and the utilization gas pipe 61. The third branch pipe 73 includes the utilization liquid pipe 62.

[Operation of Air Conditioning System]

Description is made hereinafter with reference to FIG. 2 of a case where all the indoor units 120 in operation in the air conditioning system 100 execute cooling operation (hereinafter, also referred to as "full cooling operation"), a case where all the indoor units 120 in operation execute heating operation (hereinafter, also referred to as "full heating operation"), and a case where some of the indoor units 120 in operation execute cooling operation and the remaining indoor units 120 execute heating operation (hereinafter, also referred to as "cooling and heating mixed operation").

(Full Cooling Operation)

During full cooling operation, the first valve EV1 in the switching unit 70 is fully opened. The second valve EV2 is fully opened. In the indoor unit 120 being stopped, during any one of full cooling operation, full heating operation, and cooling and heating mixed operation, the first valve EV1 corresponding to this indoor unit 120 has a minimum opening degree, and the second valve EV2 is fully closed.

When the compressor 25 is driven, a high-pressure gas refrigerant compressed by the compressor 25 passes through the first flow path switching valve 26, the third flow path switching valve 28, and the like, and flows into the outdoor heat exchanger 30 to be condensed. The refrigerant condensed in the outdoor heat exchanger 30 passes through the first and second outdoor expansion valves 34 and 35, the liquid-side shutoff valve 23, and the like, and flows into the liquid connection pipe 11.

The refrigerant having flowed into the liquid connection pipe 11 flows in the third header pipe 57 of the refrigerant flow path switching device 130, passes through the utilization liquid pipe 62 of each of the switching units 70, and flows into the indoor unit 120. The refrigerant having flowed into the indoor unit 120 is decompressed at the indoor expansion valve 51 and is then evaporated in the indoor heat exchanger 52.

In the indoor unit 120, the refrigerant evaporated in the indoor heat exchanger 52 flows from the gas tube GP into the utilization gas pipe 61, mainly passes through the second valve EV2, and flows into the second header pipe 56.

The refrigerant having flowed into the second header pipe 56 passes through the suction gas connection pipe 12, flows into the outdoor unit 110, and is sucked into the compressor 25.

The refrigerant having flowed into the utilization gas pipe 61 also passes through the first valve EV1 and flows into the first header pipe 55. The refrigerant (low-pressure gas refrigerant) having flowed into the first header pipe 55 passes through the high and low-pressure gas connection pipe 13, the second flow path switching valve 27, and the accumulator 24, and is sucked into the compressor 25.

(Regarding Full Heating Operation)

During full heating operation, the first valve EV1 in the switching unit 70 is fully opened. The second valve EV2 is fully closed. When the compressor 25 is driven, the high-pressure gas refrigerant compressed by the compressor 25 passes through the second flow path switching valve 27 and the like, and flows into the high and low-pressure gas connection pipe 13. The refrigerant having flowed into the high and low-pressure gas connection pipe 13 passes through the first header pipe 55 of the refrigerant flow path switching device 130, the first refrigerant tube P1 of the switching unit 70, and then the first valve EV1, and flows from the utilization gas pipe 61 into the gas tube GP of the indoor unit 120.

The refrigerant having flowed into the gas tube GP flows into the indoor heat exchanger 52 of the indoor unit 120 to be condensed. The condensed refrigerant passes through the indoor expansion valve 51, flows in the liquid tube LP, passes through the utilization liquid pipe 62 of the switching unit 70, and flows into the third header pipe 57.

The refrigerant having flowed into the third header pipe 57 flows in the liquid connection pipe 11, flows into the outdoor unit 110, and is decompressed at the first and second outdoor expansion valves 34 and 35. The decompressed refrigerant is evaporated while passing through the outdoor heat exchanger 30, passes through the first flow path switching valve 26, the third flow path switching valve 28, and the like, and is sucked into the compressor 25.

(Regarding Cooling and Heating Mixed Operation)

In the switching unit 70 (hereinafter, also referred to as a "cooling switching unit 70") corresponding to the indoor unit 120 (hereinafter, also referred to as a "cooling indoor unit 120") executing cooling operation among the indoor units 120 in operation, the first valve EV1 has the minimum opening degree. The second valve EV2 is fully opened.

In the switching unit 70 (hereinafter, also referred to as a "heating switching unit 70") corresponding to the indoor unit 120 (hereinafter, also referred to as a "heating indoor unit 120") executing heating operation among the indoor units 120 in operation, the first valve EV1 is fully opened. The second valve EV2 is fully closed.

When the compressor 25 is driven, part of the high-pressure gas refrigerant compressed by the compressor 25 passes through the second flow path switching valve 27 and the like, and flows into the high and low-pressure gas connection pipe 13. The remaining part of the high-pressure gas refrigerant compressed by the compressor 25 passes through the third flow path switching valve 28, is condensed at the first heat exchange unit 31 of the outdoor heat exchanger 30, passes through the first outdoor expansion valve 34, and flows into the liquid connection pipe 11. The refrigerant having been condensed at the first heat exchange unit 31 passes through the second outdoor expansion valve 35, is evaporated at the second heat exchange unit 32, passes through the first flow path switching valve 26, and is sucked into the compressor 25.

The refrigerant having flowed into the high and low-pressure gas connection pipe 13 flows into the first header pipe 55 of the refrigerant flow path switching device 130, flows in the first refrigerant tube P1, the first valve EV1, and the utilization gas pipe 61 of the heating switching unit 70, and flows into the gas tube GP.

The refrigerant having flowed into the gas tube GP is condensed in the indoor heat exchanger 52 of the heating indoor unit 120. The condensed refrigerant passes through the utilization liquid pipe 62 of the heating switching unit 70 from the liquid tube LP, and flows into the third header pipe 57.

The refrigerant having flowed from the outdoor unit 110 into the liquid connection pipe 11 also flows into the third header pipe 57. The refrigerant having flowed into the third header pipe 57 passes through the utilization liquid pipe 62 and the liquid tube LP of the cooling switching unit 70, and flows into the cooling indoor unit 120.

The refrigerant having flowed into the cooling indoor unit 120 is decompressed at the indoor expansion valve 51, and is evaporated in the indoor heat exchanger 52 to cool the indoor space.

The evaporated refrigerant flows in the gas tube GP, flows into the utilization gas pipe 61 of the cooling switching unit 70, passes through the second valve EV2, flows into the fourth refrigerant tube P4 and the second header pipe 56, and flows in the suction gas connection pipe 12 to be sucked into the compressor 25.

[Exemplary Connection of Refrigerant Flow Path Switching Device]

Figure 4:
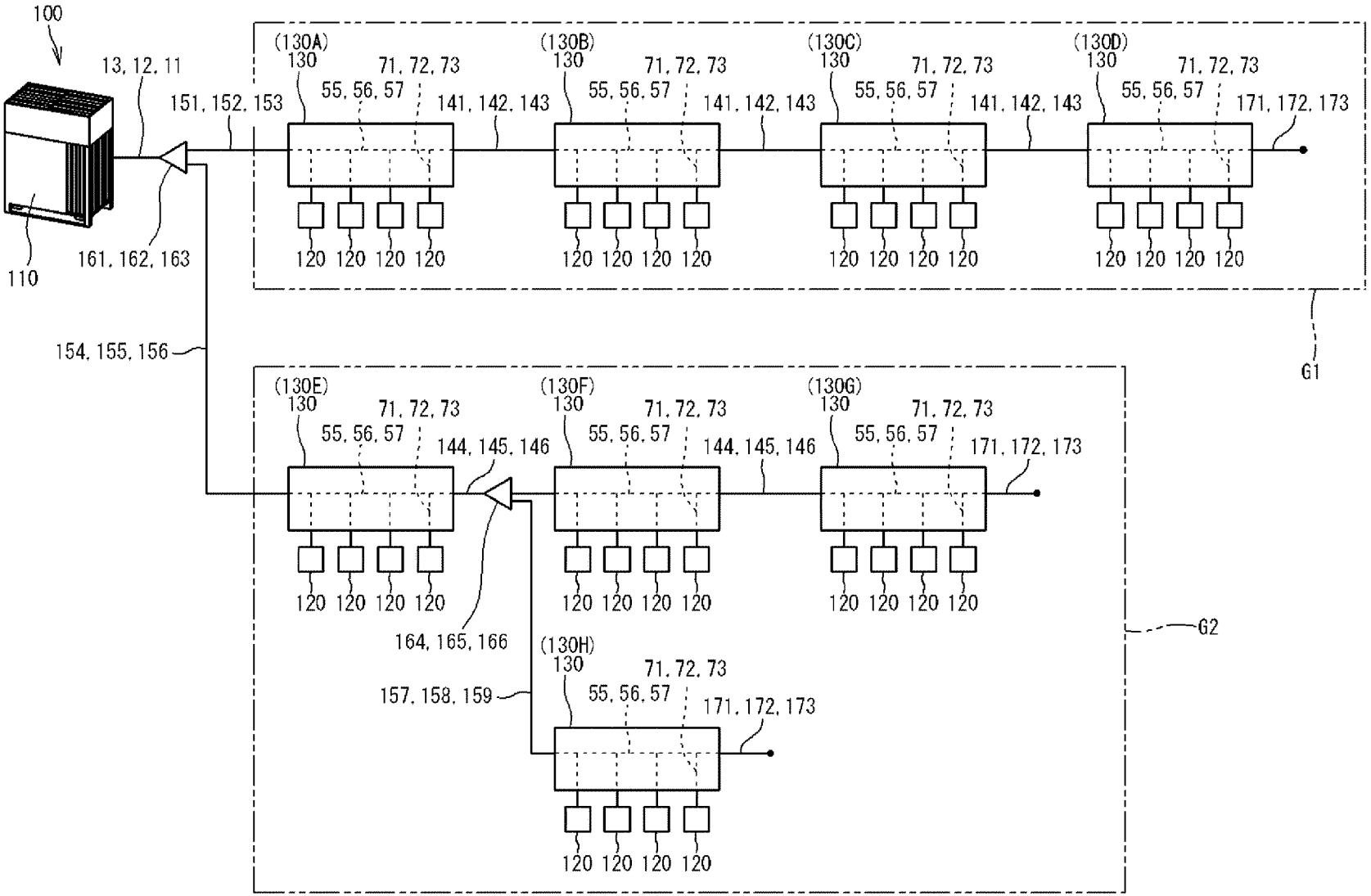
FIG. 4 is a pipe system diagram illustrating an exemplary connection of the refrigerant flow path switching device in the air conditioning system.

FIG. 4 is a pipe system diagram illustrating an exemplary connection of the refrigerant flow path switching device in the air conditioning system.

The air conditioning system 100 according to one or more embodiments includes a first refrigerant flow path switching device group G1 and a second refrigerant flow path switching device group G2. Each of the first refrigerant flow path switching device group G1 and the second refrigerant flow path switching device group G2 includes a plurality of (four in FIG. 4) refrigerant flow path switching devices 130.

The first refrigerant flow path switching device group G1 includes a refrigerant flow path switching device 130A, a refrigerant flow path switching device 130B, a refrigerant flow path switching device 130C, and a refrigerant flow path switching device 130D connected in series. In each of the adjacent refrigerant flow path switching devices 130A, 130B, 130B, 130C, 130C, and 130D, the first header pipes 55, the second header pipes 56, and the third header pipes 57 are connected to each other via first connecting pipes (external pipes) 141, 142, and 143.

One end of each of first on-site pipes (external pipes) 151, 152, and 153 is connected to each of upstream ends of the first header pipe 55, the second header pipe 56, and the third header pipe 57 of the refrigerant flow path switching device 130A disposed at a most upstream side. The other end of each of the first on-site pipes 151, 152, and 153 is connected to the high and low-pressure gas connection pipe 13, the suction gas connection pipe 12, and the liquid connection pipe 11, which are external pipes extending from the outdoor unit 110, via first branch pipes (external pipes) 161, 162, and 163. The refrigerant flow path switching devices 130A to 130D are thus connected in series to the outdoor unit 110.

Closing pipes 171, 172, and 173 are connected to each of downstream ends of the first header pipe 55, the second header pipe 56, and the third header pipe 57 of the refrigerant flow path switching device 130D disposed at a most downstream side.

The second refrigerant flow path switching device group G2 includes, for example, a refrigerant flow path switching device 130E, a refrigerant flow path switching device 130F, and a refrigerant flow path switching device 130G connected in series, and a refrigerant flow path switching device 130H branched downstream of the refrigerant flow path switching device 130E and connected in parallel with the refrigerant flow path switching device 130F.

In each of the refrigerant flow path switching devices 130E and 130F, and 130F and 130G adjacent in one direction, the first header pipes 55, the second header pipes 56, and the third header pipes 57 are connected to each other via second connecting pipes (external pipes) 144, 145, and 146.

One end of each of second on-site pipes (external pipes) 154, 155, and 156 is connected to each of the upstream ends of the first header pipe 55, the second header pipe 56, and the third header pipe 57 of the refrigerant flow path switching device 130E disposed at one end in an arrangement direction. The other end of each of the second on-site pipes 154, 155, and 156 is connected to the high and low-pressure gas connection pipe 13, the suction gas connection pipe 12, and the liquid connection pipe 11 extending from the outdoor unit 110, via the first branch pipes 161, 162, and 163. The refrigerant flow path switching devices 130E to 130G are thus connected in series to the outdoor unit 110.

One end of each of third on-site pipes (external pipes) 157, 158, and 159 is connected to each of the upstream ends of the first header pipe 55, the second header pipe 56, and the third header pipe 57 of the refrigerant flow path switching device 130H disposed separately from the arrangement direction. The other end of each of the third on-site pipes 157, 158, and 159 is connected to second branch pipes (external pipes) 164, 165, and 166 provided at a center in a longitudinal direction of the second on-site pipes 154, 155, and 156 between the refrigerant flow path switching device 130E and the refrigerant flow path switching device 130F. The refrigerant flow path switching devices 130E and 130H are thus connected in series to the outdoor unit 110.

The closing pipes 171, 172, and 173 are connected to each of the downstream ends of the first header pipe 55, the second header pipe 56, and the third header pipe 57 of each of the refrigerant flow path switching device 130G and the refrigerant flow path switching device 130H disposed at the most downstream side.

[Setting of Pipe Length]

(First Refrigerant Flow Path Switching Device Group)

Figure 5:
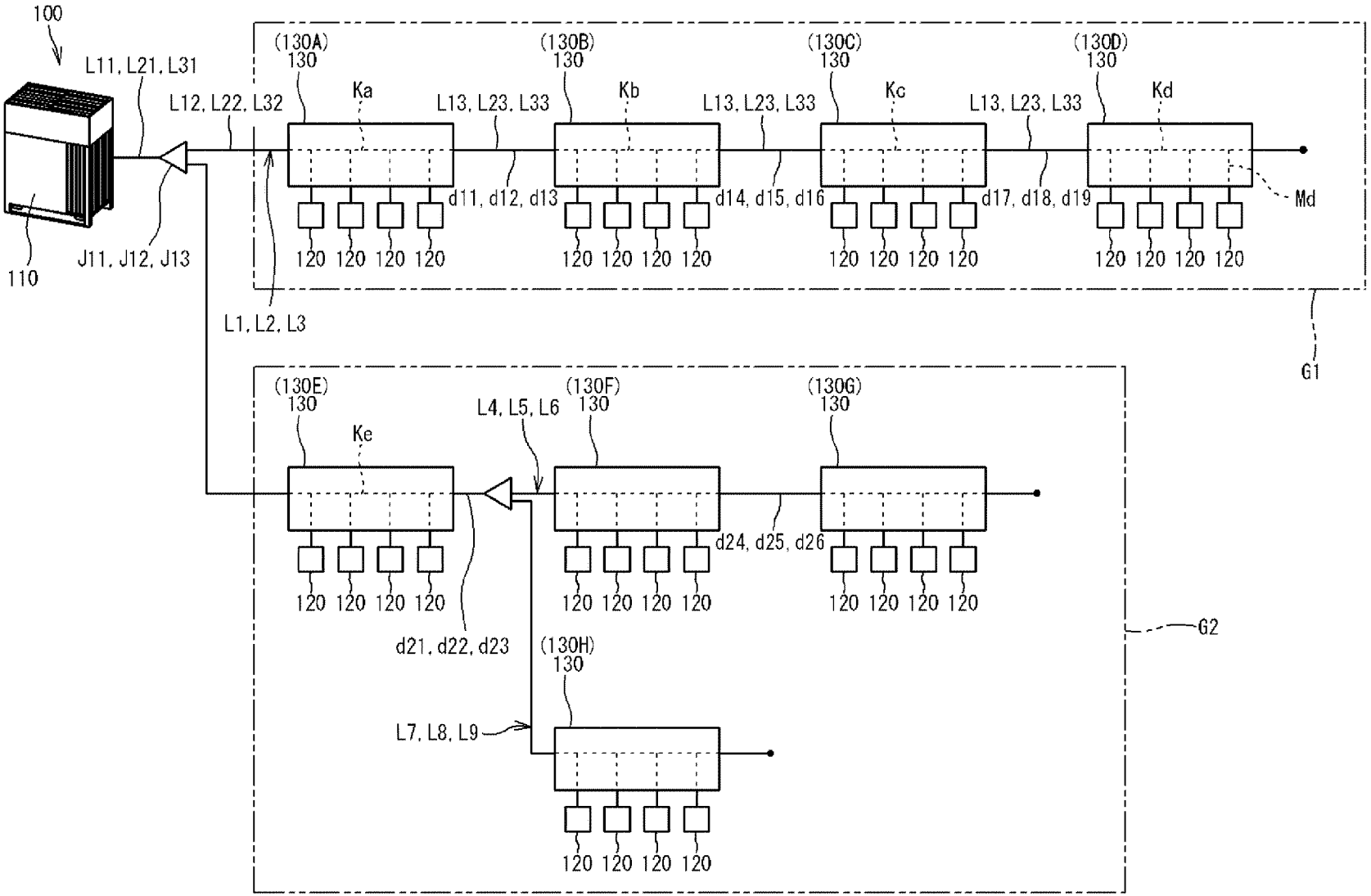
FIG. 5 is a pipe system diagram for describing a pipe length of the air conditioning system.

FIG. 5 is a pipe system diagram for describing a pipe length of the air conditioning system. The pipe length is a sum of lengths of the external pipes from the outdoor unit 110 to the indoor unit 120 via the refrigerant flow path switching device 130. As illustrated in FIG. 4 and FIG. 5, in the refrigerant flow path switching devices 130A to 130D of the first refrigerant flow path switching device group G1 connected to each other in series, a maximum pipe length L1 of pipe lengths from the outdoor unit 110 to the indoor units 120 connected to the each of the refrigerant flow path switching devices 130A to 130D via the high and low-pressure gas connection pipe 13 is a pipe length from the outdoor unit 110 to each of the indoor units 120 connected to the refrigerant flow path switching device 130D located on the most downstream side via the high and low-pressure gas connection pipe 13. The maximum pipe length L1 can be calculated by the following formula (1).

$$L1=L11+L12+(L13\times 3) \quad (1)$$

L11 is a length of the high and low-pressure gas connection pipe 13. L12 is a length of the first on-site pipe 151. L13 is a length of the first connecting pipe 141.

In the refrigerant flow path switching devices 130A to 130D connected to each other in series, a maximum pipe length L2 of pipe lengths from the outdoor unit 110 to the indoor units 120 connected to the each of the refrigerant flow path switching devices 130A to 130D via the suction gas connection pipe 12 is a pipe length from the outdoor unit 110 to each of the indoor units 120 connected to the refrigerant flow path switching device 130D located on the most downstream side via the suction gas connection pipe 12. The maximum pipe length L2 can be calculated by the following formula (2).

$$L2=L21+L22+(L23\times 3) \quad (2)$$

L21 is a length of the suction gas connection pipe 12. L22 is a length of the first on-site pipe 152. L23 is a length of the first connecting pipe 142.

In the refrigerant flow path switching devices 130A to 130D connected to each other in series, a maximum pipe length L3 of pipe lengths from the outdoor unit 110 to the indoor units 120 connected to the each of the refrigerant flow path switching devices 130A to 130D via the liquid connection pipe 11 is a pipe length from the outdoor unit 110 to each of the indoor units 120 connected to the refrigerant flow path switching device 130D located on the most downstream side via the liquid connection pipe 11. The maximum pipe length L3 can be calculated by the following formula (3).

$$L3=L31+L32+(L33\times 3) \quad (3)$$

L31 is a length of the liquid connection pipe 11. L32 is a length of the first on-site pipe 153. L33 is a length of the first connecting pipe 143.

Each of the maximum pipe lengths L1, L2, and L3 is set to be equal to or less than a predetermined upper limit value. At this time, the maximum pipe lengths L1, L2, and L3 are set so as to satisfy the following formulas (4), (5), and (6), respectively, in consideration of the first branch pipes 161, 162, and 163, the header pipes 55, 56, and 57 of the refrigerant flow path switching devices 130A to 130D, and the like disposed between the outdoor unit 110 and the indoor units 120 connected to the refrigerant flow path switching device 130D.

$$L1+J11+Ka+Kb+Kc+Kd+Md\leq Lu \quad (4)$$

$$L2+J12+Ka+Kb+Kc+Kd+Md\leq Lu \quad (5)$$

$$L3+J13+Ka+Kb+Kc+Kd+Md\leq Lu \quad (6)$$

J11, J12, and J13 are correction lengths determined in consideration of the first branch pipes 161, 162, and 163, respectively, disposed between the outdoor unit 110 and the refrigerant flow path switching device 130D. J11, J12, and J13 in one or more embodiments are determined to be constant values (for example, 0.5 m) in consideration of a pressure loss of each of the first branch pipes 161, 162, and 163, for example.

Lu is a value defined by a standard or the like, and is an upper limit length (upper limit value) of a maximum pipe length from the outdoor unit 110 to the indoor unit 120 connected to the refrigerant flow path switching device 130 located on the most downstream side in the plurality of refrigerant flow path switching devices 130 connected in series. For example, Lu is 120 m.

Ka is a common value used as a length of the first header pipe 55, a length of the second header pipe 56, and a length of the third header pipe 57 in the refrigerant flow path switching device 130A. Ka is determined in consideration of a pressure loss of the header pipes 55 to 57. Specifically, Ka is a first value determined in accordance with a sum of capabilities of the plurality of indoor units 120 connected to the refrigerant flow path switching device 130A and the refrigerant flow path switching devices 130B, 130C, and 130D located downstream of the refrigerant flow path switching device A.

Kb is a common value used as a length of the first header pipe 55, a length of the second header pipe 56, and a length of the third header pipe 57 in the refrigerant flow path switching device 130B. Kb is determined in consideration of a pressure loss of the header pipes 55 to 57. Specifically, Kb is a first value determined in accordance with a sum of capabilities of the plurality of indoor units 120 connected to the refrigerant flow path switching device 130B and the refrigerant flow path switching devices 130C and 130D located downstream of the refrigerant flow path switching device B.

Kc is a common value used as a length of the first header pipe 55, a length of the second header pipe 56, and a length of the third header pipe 57 in the refrigerant flow path switching device 130C. Kc is determined in consideration of a pressure loss of the header pipes 55 to 57. Specifically, Kc is a first value determined in accordance with a sum of capabilities of the plurality of indoor units 120 connected to the refrigerant flow path switching device 130C and the refrigerant flow path switching device 130D located downstream of the refrigerant flow path switching device C.

Kd is a common value used as a length of the first header pipe 55, a length of the second header pipe 56, and a length of the third header pipe 57 in the refrigerant flow path switching device 130D. Kd is determined in consideration of a pressure loss of the header pipes 55 to 57. Specifically, Kd is a first value determined in accordance with a sum of capabilities of the plurality of indoor units 120 connected to the refrigerant flow path switching device 130D.

Md is a common value used as a length of the first branch pipe 71, a length of the second branch pipe 72, and a length of the third branch pipe 73 in the refrigerant flow path switching device 130D. Md is a second value determined to be a constant value (for example, 4.3 m) in consideration of a pressure loss of the branch pipes 71 to 73.

FIG. 6 is a table exemplifying the first value corresponding to the sum of the capabilities of the plurality of indoor units. In FIG. 6, the capacity of the indoor unit 120 is used as the capability of the indoor unit 120, and the smaller a sum of the capacities (capabilities) of the indoor units 120, the smaller the first value. The first values Ka, Kb, Kc, and Kd are determined on the basis of the table in FIG. 6. As the capability of the indoor unit 120, power consumption of the indoor unit 120 or the like may be used in addition to the capacity of the indoor unit 120.

In one or more embodiments, in the refrigerant flow path switching devices 130A to 130D of the first refrigerant flow path switching device group G1 connected in series to each other, the refrigerant flow path switching device located on the downstream side has a smaller sum of the capacities of the indoor units 120 connected to the own device and the refrigerant flow path switching device located on the downstream side. Accordingly, the first values Ka, Kb, Kc, and Kd respectively corresponding to the refrigerant flow path switching devices 130A to 130D are set to gradually smaller values in that order.

For example, when the capacity of each indoor unit 120 connected to the refrigerant flow path switching devices 130A to 130C is 3.5 kw and the capacity of each indoor unit 120 connected to the refrigerant flow path switching device 130D is 7.0 kw, the first values Ka, Kb, Kc, and Kd corresponding to the refrigerant flow path switching devices 130A to 130D are determined as follows.

The first value Ka corresponding to the refrigerant flow path switching device 130A is determined to be a value corresponding to the sum of the capacities of a total of 16 indoor units 120 connected to the refrigerant flow path switching devices 130A to 130D. Since 70.0 kw (=3.5×12+7.0×4), which is the sum of the capacities, corresponds to "67.4 or more and less than 85.0" in the table in FIG. 6, the first value Ka is set to 4.3 m.

The first value Kb corresponding to the refrigerant flow path switching device 130B is determined to be a value corresponding to the sum of the capacities of a total of 12 indoor units 120 connected to the refrigerant flow path switching devices 130B to 130D. Since 56.0 kw (=3.5×8+7.0×4), which is the sum of the capacities, corresponds to "47.5 or more and less than 67.4" in the table in FIG. 6, the first value Kb is set to 2.2 m.

The first value Kc corresponding to the refrigerant flow path switching device 130C is determined to be a value corresponding to the sum of the capacities of a total of 8 indoor units 120 connected to the refrigerant flow path switching devices 130C and 130D. Since 42.0 kw (=3.5×4+7.0×4), which is the sum of the capacities, corresponds to "32.5 or more and less than 47.5" in the table in FIG. 6, the first value Kc is set to 1.6 m.

The first value Kd corresponding to the refrigerant flow path switching device 130D is determined to be a value corresponding to the sum of the capacities of a total of four indoor units 120 connected to the refrigerant flow path switching device 130D. Since 28.0 kw (=7.0×4), which is the sum of the capacities, corresponds to "21.0 or more and less than 32.5" in the table in FIG. 6, the first value Kd is set to 0.7 m.

(Second Refrigerant Flow Path Switching Device Group)

As illustrated in FIG. 4 and FIG. 5, in the refrigerant flow path switching devices 130E to 130G of the second refrigerant flow path switching device group G2 connected to each other in series, maximum pipe lengths L4, L5, and L6, which are pipe lengths from the outdoor unit 110 to the indoor units 120 connected to the refrigerant flow path switching device 130G located on the most downstream side via the high and low-pressure gas connection pipe 13, the suction gas connection pipe 12, and the liquid connection pipe 11, respectively, are set by using similar calculation formulas to the maximum pipe lengths L1, L2, and L3.

In the refrigerant flow path switching devices 130E and 130H of the second refrigerant flow path switching device group G2 connected to each other in series, maximum pipe lengths L7, L8, and L9, which are pipe lengths from the outdoor unit 110 to the indoor units 120 connected to the refrigerant flow path switching device 130H located on the most downstream side via the high and low-pressure gas connection pipe 13, the suction gas connection pipe 12, and the liquid connection pipe 11, respectively, are set by using similar calculation formulas to the maximum pipe lengths L1, L2, and L3.

However, when the maximum pipe lengths L4 to L9 are set, the first value Ke used as the length of each of the header pipes 55, 56, and 57 of the refrigerant flow path switching device 130E is determined in accordance with the sum of the capabilities of the plurality of indoor units 120 connected to the refrigerant flow path switching device 130E and all the refrigerant flow path switching devices 130F, 130G, and 130H located downstream of the refrigerant flow path switching device 130E.

[Setting of Pipe Diameters of Connecting Pipes]

(First Refrigerant Flow Path Switching Device Group)

As shown in FIG. 4 and FIG. 5, in the first refrigerant flow path switching device group G1, pipe diameters of the first connecting pipes 141, 142, and 143 connecting the refrigerant flow path switching devices 130A to 130D to each other in series are set in accordance with the sum of the capabilities of the plurality of indoor units 120 connected to the refrigerant flow path switching devices 130 located downstream of the first connecting pipes 141, 142, and 143.

Specifically, pipe diameters d11, d12, and d13 of the first connecting pipes 141, 142, and 143 connecting the adjacent refrigerant flow path switching devices 130A and 130B to each other are set in accordance with the sum of the capabilities of the plurality of indoor units 120 connected to the refrigerant flow path switching devices 130B, 130C, and 130D located downstream of the first connecting pipes 141, 142, and 143.

Pipe diameters d14, d15, and d16 of the first connecting pipes 141, 142, and 143 connecting the adjacent refrigerant flow path switching devices 130B and 130C to each other are set in accordance with the sum of the capabilities of the plurality of indoor units 120 connected to the refrigerant flow path switching devices 130C and 130D located downstream of the first connecting pipes 141, 142, and 143.

Pipe diameters d17, d18, and d19 of the first connecting pipes 141, 142, and 143 connecting the adjacent refrigerant flow path switching devices 130C and 130D to each other are set in accordance with the sum of the capabilities of the plurality of indoor units 120 connected to the refrigerant flow path switching device 130D located downstream of the first connecting pipes 141, 142, and 143.

In one or more embodiments, when the pipe diameters d11 to d13, d14 to d16, and d17 to d19 are determined, for example, the capacity of the indoor unit 120 is used as the capability of the indoor unit 120. The pipe diameters d11 to d13, d14 to d16, and d17 to d19 are set to smaller values as the sum of the capacities (capabilities) of the indoor units 120 decreases. As the capability of the indoor unit 120, power consumption of the indoor unit 120 or the like may be used in addition to the capacity of the indoor unit 120.

In the refrigerant flow path switching devices 130A to 130D connected in series to each other, the refrigerant flow path switching device located on the downstream side has a smaller sum of the capacities of the indoor units 120 connected to the own device and the refrigerant flow path switching device located on the downstream side. Therefore, the pipe diameters d11 to d13 are set to smaller values than the pipe diameters d14 to d16, and the pipe diameters d14 to d16 are set to smaller values than the pipe diameters d17 to d19.

(Second Refrigerant Flow Path Switching Device Group)

In the second refrigerant flow path switching device group G2, the pipe diameters d21 to d23 and d24 to d26 of the second connecting pipe 144, 145, and 146 connecting the refrigerant flow path switching devices 130E to 130G to each other in series are set by a similar method to the pipe diameters d11 to d13, d14 to d16, and d17 to d19.

A pipe length from the outdoor unit to the indoor units via the refrigerant flow path switching device is set such that a value obtained by adding a predetermined first value to the pipe length is within a predetermined upper limit value. The first value is determined in consideration of a pressure loss of a refrigerant pipe in the refrigerant flow path switching device, and is set to a relatively large constant value in accordance with a case where the pressure loss is maximum. However, depending on a capacity of the indoor unit, the pressure loss of the refrigerant pipe becomes small, and the first value may be made smaller than a constant value. Even in such a case, when the pipe length is set by using the first value at the constant value, the pipe length is limited to be shorter than necessary.

One or more embodiments of the present disclosure provide an air conditioning system capable of increasing a pipe length from an outdoor unit to an indoor unit.

Operation and Effects of Embodiments

In the air conditioning system 1 according to one or more embodiments, the maximum pipe lengths L1 to L3 corresponding to the plurality of refrigerant flow path switching devices 130A to 130D connected to each other in series can be obtained by subtracting the first values Ka to Kd and the like from the value of the upper limit length Lu by formulas (4) to (6). The first values Ka, Kb, Kc, and Kd are determined in accordance with the sum of the capacities of the indoor units 120 connected to the corresponding refrigerant flow path switching devices 130A, 130B, 130C, and 130D and the refrigerant flow path switching devices 130B to 130D, 130C and 130D, and 130D located downstream of the refrigerant flow path switching devices 130A, 130B, 130C, and 130D. Therefore, since the first values Ka, Kb, Kc, and Kd are determined as more appropriate pipe lengths, it is possible to increase the maximum pipe lengths L1 to L3 as compared with a case where the first values are set as fixed values and the capacities of the indoor units connected downstream are set to an allowable value at a maximum.

The maximum pipe lengths L4 to L6 corresponding to the plurality of refrigerant flow path switching devices 130E to 130G connected to each other in series and the maximum pipe lengths L7 to L9 corresponding to the plurality of refrigerant flow path switching devices 130E and 130H connected to each other in series can also be increased similarly to the maximum pipe lengths L1 to L3.

The maximum pipe lengths L1 to L3 corresponding to the plurality of refrigerant flow path switching devices 130A to 130D connected to each other in series are set such that a value obtained by further adding correction lengths J11 to J13 considering the pressure loss of the first branch pipes 161 to 163 to the maximum pipe lengths L1 to L3 is equal to or less than the upper limit length Lu, as shown in formulas (4) to (6). As a result, the maximum pipe lengths L1 to L3 can be set to appropriate values.

The maximum pipe lengths L4 to L6 corresponding to the plurality of refrigerant flow path switching devices 130E to 130G connected to each other in series and the maximum pipe lengths L7 to L9 corresponding to the plurality of refrigerant flow path switching devices 130E and 130H connected to each other in series can also be set to appropriate values similarly to the maximum pipe lengths L1 to L3.

In the plurality of refrigerant flow path switching devices 130A to 130D connected to each other in series, the pipe diameters d11 to d13, d14 to d16, and d17 to d19 of the first connecting pipes 141 to 143 connecting the adjacent refrigerant flow path switching devices 130 to each other are set in accordance with the sum of the capabilities of the indoor units 120 connected to the refrigerant flow path switching devices 130 located downstream of the first connecting pipes 141 to 143. Thus, the pipe diameters d11 to d13, d14 to d16, and d17 to d19 of the first connecting pipe 141 to 143 can be set to appropriate values. As a result, it is possible to avoid such an event that oil cannot be returned during an oil return operation due to the pipe diameters d11 to d13, d14 to d16, and d17 to d19 being excessively thick, or that the pressure loss increases due to the pipe diameters d11 to d13, d14 to d16, and d17 to d19 being excessively thin.

As for pipe diameters d21 to d23 and d24 to d26 of the second connecting pipe 144 to 146, similarly to the pipe diameters d11 to d13 and the like of the first connecting pipe 141 to 143, it is possible to avoid such an event that the oil cannot be returned or the pressure loss increases during the oil return operation.

[Another Exemplary Connection of Refrigerant Flow Path Switching Device]

Figure 7:
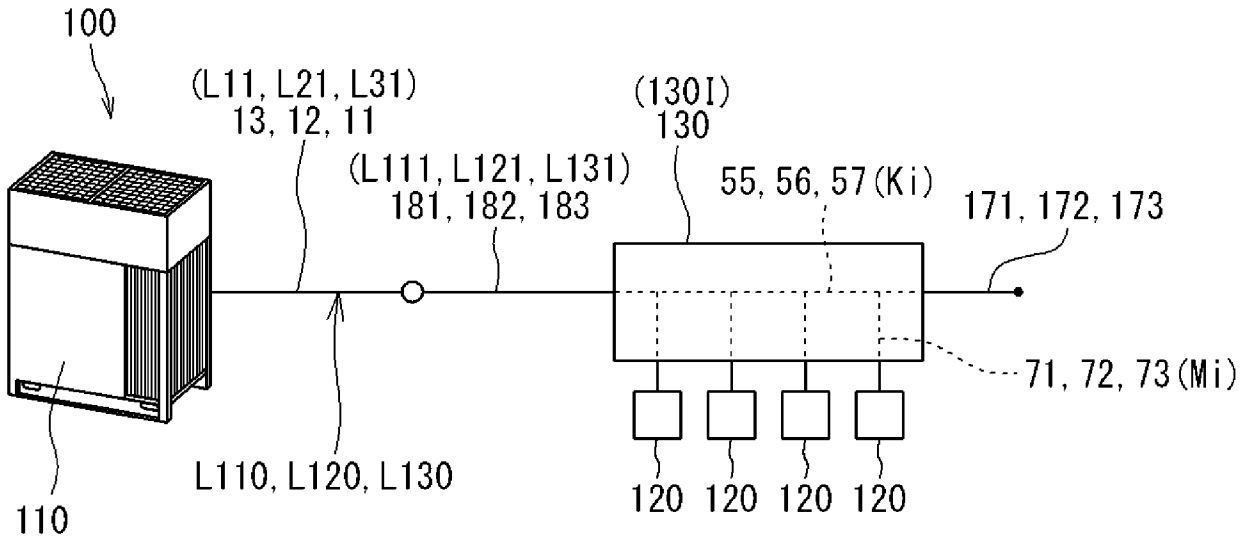
FIG. 7 is a pipe system diagram illustrating another exemplary connection of the refrigerant flow path switching device in the air conditioning system.

FIG. 7 is a pipe system diagram illustrating another exemplary connection of the refrigerant flow path switching device in the air conditioning system.

In FIG. 7, the air conditioning system 100 includes one refrigerant flow path switching device 130 (hereinafter, referred to as a refrigerant flow path switching device 130I) connected to the outdoor unit 110.

One end of each of fourth on-site pipes (external pipes) 181, 182, and 183 is connected to each of upstream ends of the first header pipe 55, the second header pipe 56, and the third header pipe 57 of the refrigerant flow path switching device 130I. The other end of each of the fourth on-site pipe 181, 182, and 183 is directly connected to the high and low-pressure gas connection pipe 13, the suction gas connection pipe 12, and the liquid connection pipe 11 extending from the outdoor unit 110. The closing pipes 171, 172, and 173 are connected to each of downstream ends of the first header pipe 55, the second header pipe 56, and the third header pipe 57 of the refrigerant flow path switching device 130I.

A pipe length L110 from the outdoor unit 110 to each indoor unit 120 connected to the refrigerant flow path switching device 130I via the high and low-pressure gas connection pipe 13 can be calculated by the following formula (7).

$$L110=L11+L111 \tag{7}$$

L11 is a length of the high and low-pressure gas connection pipe 13. L111 is a length of the fourth on-site pipe 181.

A pipe length L120 from the outdoor unit 110 to each indoor unit 120 connected to the refrigerant flow path switching device 130I via the suction gas connection pipe 12 can be calculated by the following formula (8).

$$L120=L21+L121 \tag{8}$$

L21 is a length of the suction gas connection pipe 12. L121 is a length of the fourth on-site pipe 182.

A pipe length L130 from the outdoor unit 110 to each indoor unit 120 connected to the refrigerant flow path switching device 130I via the liquid connection pipe 11 can be calculated by the following formula (9).

$$L130=L31+L131 \tag{9}$$

L31 is a length of the liquid connection pipe 11. L131 is a length of the fourth on-site pipe 183.

Each of the maximum pipe lengths L110, L120, and L130 is set to be equal to or less than the upper limit length Lu. At this time, the pipe lengths L110, L120, and L130 are set so as to satisfy the following formulas (10), (11), and (12), respectively, in consideration of the header pipes 55, 56, and 57 of the refrigerant flow path switching device 130I.

$$L110+Ki+Mi\leq Lu \tag{10}$$

$$L120+Ki+Mi\leq Lu \tag{11}$$

$$L130+Ki+Mi\leq Lu \tag{12}$$

Ki is a common value used as a length of the first header pipe 55, a length of the second header pipe 56, and a length of the third header pipe 57 in the refrigerant flow path switching device 130I. Ki is determined in consideration of a pressure loss of the header pipes 55 to 57. Specifically, Ki is a first value determined in accordance with a sum of capabilities of the plurality of indoor units 120 connected to the refrigerant flow path switching device 130I.

Mi is a common value used as a length of the first branch pipe 71, a length of the second branch pipe 72, and a length of the third branch pipe 73 in the refrigerant flow path switching device 130I. Mi is a second value determined to be a constant value (for example, 4.3 m) in consideration of a pressure loss of the branch pipes 71 to 73.

The first value Ki is determined on the basis of the table in FIG. 6. For example, when the capacity of each indoor unit 120 connected to the refrigerant flow path switching device 130I is 3.5 kw, the first value Ki is set to a value corresponding to the sum of the capacities of a total of four indoor units 120. Since 14.0 kw (=3.5×4), which is the sum of the capacities, corresponds to "less than 21.0" in the table in FIG. 6, the first value Ki is set to 0.4 m.

In the air conditioning system 1 in FIG. 7, the pipe lengths L110, L120, and L130 corresponding to the refrigerant flow path switching device 130I can be obtained by subtracting the first value Ki or the like from the value of the upper limit length Lu by formulas (10) to (12). As a result, the smaller the sum of the capacities of the indoor units 120 connected to the refrigerant flow path switching device 130I, the smaller the first value Ki. Therefore, the pipe lengths L110, L120, and L130 can be increased by a decrease in the first value Ki.

[Other Modifications]

The present disclosure is not limited to the above-described embodiments, and various modifications may be made within the scope of the claims.

For example, the air conditioning system 100 in FIG. 4 includes the two refrigerant flow path switching device groups G1 and G2, but may include three or more refrigerant flow path switching device groups.

In the pipe system in FIG. 4 and FIG. 5, the maximum pipe length is set such that the value obtained by adding the first value, the second value, and the correction length of the branch pipes 161 to 166 to the maximum pipe length is equal to or less than the upper limit value. However, the maximum pipe length may be set such that a value obtained by adding at least the first value to the maximum pipe length is equal to or less than the upper limit value. Similarly, in the pipe system in FIG. 7, the pipe length is set such that the value obtained by adding the first value and the second value to the pipe length is equal to or less than the upper limit value. However, the pipe length may be set such that a value obtained by adding at least the first value to the pipe length is equal to or less than the upper limit value.

In the pipe system in FIG. 4 and FIG. 5, the first value corresponding to the refrigerant pipes (header pipe 55 to 57) of the refrigerant flow path switching device 130 is determined in accordance with the sum of the capabilities of the indoor units 120 connected to all the refrigerant flow path switching devices 130 located downstream of the refrigerant flow path switching device 130. However, the first value may be determined in accordance with the sum of the capabilities of the indoor units 120 connected to some of the refrigerant flow path switching devices 130 located downstream of the refrigerant flow path switching device.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioning system
11 liquid connection pipe (external pipe)
12 suction gas connection pipe (external pipe)
13 high and low-pressure gas connection pipe (external pipe)
110 outdoor unit
120 indoor unit
130 refrigerant flow path switching device
141 to 143 first connecting pipe (external pipe, connecting pipe)
144 to 146 second connecting pipe (external pipe, connecting pipe)
151 to 153 first on-site pipe (external pipe)
154 to 156 second on-site pipe (external pipe)
157 to 159 third on-site pipe (external pipe)
161 to 163 first branch pipe (external pipe, branch pipe)
164 to 166 second branch pipe (external pipe, branch pipe)
181 to 183 fourth on-site pipe (external pipe)
d11 to d19, d21 to d26 pipe diameter
J11 to J13, J21 to J23 correction length
Ka to Ki, Ke' first value
L1 to L9 maximum pipe length
L110, L120, L130 pipe length
Lu upper limit length (upper limit value)

What is claimed is:

1. A method for manufacturing an air conditioning system comprising: an outdoor unit; indoor units; one or more refrigerant flow path switching devices that switch flow paths of a refrigerant between the outdoor unit and the indoor units; and external pipes connecting adjacent ones among the outdoor unit, the indoor units, and the one or more refrigerant flow path switching devices, the method comprising:

determining an upper limit of a longest refrigerant passage in the air conditioning system from the outdoor unit to the indoor units via the one or more refrigerant flow path switching devices;

determining a first equivalent length corresponding to pressure loss of refrigerant in one of the one or more refrigerant flow path switching devices based on a sum of either capacities or power consumption of the indoor units connected to that refrigerant flow path switching device;

calculating an upper limit of a total length of the external pipes in the longest refrigerant passage such that a first sum is equal to or less than the upper limit of the longest refrigerant passage, wherein the first sum is a sum of:

the total length of the external pipes, and the first equivalent length; and assembling the air conditioning system such that the total length of the external pipes in the longest refrigerant passage is equal to or less than the upper limit of the total length of the external pipes in the longest refrigerant passage.

2. The method according to claim 1, wherein the air conditioning system comprises two or more refrigerant flow path switching devices connected to each other in series and that switch flow paths of the refrigerant between the outdoor unit and the indoor units, and the method further comprises:

determining each of second equivalent lengths corresponding to pressure loss of refrigerant in a corresponding one of the refrigerant flow path switching devices based on a sum of either the capacities or power consumption of the indoor units respectively connected:

to the corresponding one of the refrigerant flow path switching devices, and to the refrigerant flow path switching devices disposed downstream of the corresponding one of the refrigerant flow path switching devices; and calculating the upper limit of the total length of the external pipes in the longest refrigerant passage such that a second sum is equal to or less than the upper limit of the longest refrigerant passage, wherein the second sum is a sum of:

the total length of the external pipes, and the second equivalent lengths.

3. The method according to claim 1, wherein the air conditioning system further comprises a branch pipe between the outdoor unit and the indoor units, the method further comprises:

determining a second equivalent length corresponding to pressure loss of refrigerant in the branch pipe, and calculating the upper limit of the total length of the external pipes in the longest refrigerant passage such that a second sum is equal to or less than the upper limit of the longest refrigerant passage, wherein the second sum is a sum of:

the first sum, and the second equivalent length.

4. The method according to claim 1, wherein the air conditioning system comprises two or more refrigerant flow path switching devices connected to each other in series and that switch flow paths of the refrigerant between the outdoor unit and the indoor units, and the method further comprises determining a pipe diameter of a connecting pipe that connects adjacent ones of the refrigerant flow path switching devices based on a sum of either the capacities or power consumption of the indoor units connected to the refrigerant flow path switching devices disposed downstream of the connecting pipe.

* * * * *